US008362349B2

(12) United States Patent
Mazur et al.

(10) Patent No.: US 8,362,349 B2
(45) Date of Patent: Jan. 29, 2013

(54) TOUCH PAD DISC JOCKEY CONTROLLER

(75) Inventors: James Mazur, Hollywood, CA (US); Brian Gibson, Victoria (CA); Damon Langlois, Victoria (CA)

(73) Assignee: Gibson Guitar Corp., Nashville, TN (US)

( * ) Notice: Subject to any disclaimer, the term of this patent is extended or adjusted under 35 U.S.C. 154(b) by 536 days.

(21) Appl. No.: 12/558,469

(22) Filed: Sep. 11, 2009

(65) Prior Publication Data

US 2011/0063230 A1 Mar. 17, 2011

(51) Int. Cl.
*G10H 3/00* (2006.01)

(52) U.S. Cl. ..... 84/723; 84/600; 84/464 A

(58) Field of Classification Search ..... 84/600, 84/615, 723, 464 R, 464 A
See application file for complete search history.

(56) References Cited

U.S. PATENT DOCUMENTS

| | | | | |
|---|---|---|---|---|
| 6,541,690 | B1 | 4/2003 | Segers, Jr. | |
| 6,576,825 | B2 * | 6/2003 | Yamada et al. | 84/602 |
| 6,818,815 | B2 * | 11/2004 | Cohen | 84/645 |
| 7,010,371 | B2 * | 3/2006 | Liu | 700/94 |
| 7,046,230 | B2 | 5/2006 | Zadesky | |
| 7,072,249 | B2 | 7/2006 | Huang | |
| 7,218,578 | B2 * | 5/2007 | Usui | 369/30.27 |
| 7,238,874 | B2 * | 7/2007 | Bastian | 84/612 |
| 7,312,785 | B2 | 12/2007 | Tsuk | |
| 7,683,249 | B2 * | 3/2010 | Becker | 84/602 |
| 7,787,342 | B2 * | 8/2010 | Yamada et al. | 369/53.37 |
| 7,889,605 | B2 * | 2/2011 | Yamada et al. | 369/30.18 |
| 2002/0176327 | A1 * | 11/2002 | Yamada et al. | 369/30.26 |
| 2003/0043701 | A1 * | 3/2003 | Liu | 369/30.23 |
| 2005/0052981 | A1 * | 3/2005 | Shim et al. | 369/59.26 |
| 2007/0057922 | A1 | 3/2007 | Schultz | |
| 2007/0152983 | A1 | 7/2007 | McKillop | |
| 2007/0234889 | A1 | 10/2007 | Rotolo de Moraes | |
| 2007/0274181 | A1 | 11/2007 | Yao | |
| 2007/0280489 | A1 | 12/2007 | Roman | |
| 2008/0046098 | A1 | 2/2008 | Corbin | |
| 2008/0212437 | A1 * | 9/2008 | Kataoka et al. | 369/53.41 |
| 2008/0273009 | A1 * | 11/2008 | Goda et al. | 345/156 |
| 2009/0048694 | A1 * | 2/2009 | Matsuda et al. | 700/94 |
| 2009/0223352 | A1 * | 9/2009 | Matsuda et al. | 84/612 |
| 2009/0324192 | A1 * | 12/2009 | Ogura et al. | 386/66 |
| 2010/0014390 | A1 * | 1/2010 | Flum | 369/4 |

* cited by examiner

*Primary Examiner* — Jeffrey Donels
(74) *Attorney, Agent, or Firm* — Kathryn E. Cox; Andrea E. Bates; Bates & Bates, LLC

(57) ABSTRACT

The present invention pertains to the field of control and manipulation of a digital audio signal by a user manipulable touch sensitive control surface. The present invention is specifically applicable to user manipulation of digital audio signals by disc jockeys (DJs).

A touch sensitive surface substantially circumferential in shape is divided into two regions: an inner or central portion and an outer or circumferential portion. The inner portion responds to linear motion imparted by the user while the outer portion responds to circumferential motion. The linear motion imparted by the user in the central portion is used manipulate a digital audio data stream in order to impart a scratch effect.

8 Claims, 11 Drawing Sheets

TOUCH PAD DISC JOCKEY CONTROLLER

BACKGROUND OF THE INVENTION

1. Field of the Invention

The present invention pertains to the field of control and manipulation of a digital audio signal by a user manipulable touch sensitive control surface. The present invention is specifically applicable to user manipulation of digital audio signals by disc jockeys (DJs).

2. Description of the Prior Art

Scratch effects controllers for live disc jockey musical performances (DJing) have become a popular replacement by DJs for conventional turntable and phonographic LP records for producing a "scratch effect" or to generally manipulate the speed and direction of music.

The original "scratch effect" is a very specific sound produced when a DJ simultaneously performs two actions. The DJ rotationally manipulates a vinyl record on a phonographic turntable in a rapid forward and backward movement. While doing this, the DJ also modulates the sound from the turntable on a DJ audio mixer, by quickly moving the mixer's cross fader back and forth in a rhythmic fashion.

Scratch effects controllers 100 have been developed to simulate this user manipulation of a vinyl record on a phonographic turntable. Instead of a turntable, phonographic record, needle, and magnet cartridge, the scratch effect controller generally contains a user rotatable mechanical disc 101. This user rotatable disc can come in a variety of forms including a vinyl, metal, or plastic disc, or a jog wheel. The surface is capable of freely rotating either clockwise or counter clockwise. There is generally some type of optical encoder and optical sensor operationally attached to the user rotatable disc to detect speed, relative position, and direction of rotation. Some controllers try to more accurately simulate the functionality of a conventional phonographic turntable by having a rotatable platter under the user rotatable disc 102. For example, see U.S. Pat. No. 6,541,690 to Segers and U.S. Pat. No. 7,072,249 to Huang. This platter is often driven by a motor in order to simulate the motion and feel of phonographic turntable platter. These arrangements tend to be bulky, heavy, expensive, and complex and therefore are not ideal for portable applications. In addition, the user rotatable disc is limited to rotary motion on the entire surface and can only be used for one function at a time. For example, the disc can be used to control a scratch effect, or jog and shuttle quickly through music passage, but not both at the same time.

DJ CD players 200 have incorporated similar functionality as the scratch effect controller. They typically have a rotatable jog wheel 201 that responds to circumferential motion by the user. As with the scratch effect controller, the user rotatable jog wheel is limited to rotary motion on the entire surface and can only be used for one function at a time. Because there is a mechanical rotating jog wheel or platter, DJ CD players 200 with a user rotatable surface tend to have complex mechanical arrangements and tend to be bulky, heavy, expensive, and not ideal for portable applications.

There have been attempts to solve the problem of portability. There are several DJ controllers that contain small lightweight mechanical or opto/mechanical rotary controls. These tend to be less accurate and more difficult to control, then the previously described controllers. They also suffer from the same limitation of allowing only one function at a time on the user manipulable disc.

Other attempts to solve the portability problem have included the use of a mouse with a personal computer and specialized software that creates a scratch effect from the mouse's motion. Creating a scratch effect with a mouse is not desirable because the act of grasping the mouse is cumbersome and hinders the DJ's performance. Alternately, a computer touch pad can be used in place of the mouse. The touch pad offers the advantage of potentially better control than the mouse but suffers several disadvantages: (1) only linear motion is possible, and (2) a standard touch pad can not provide direct visual feedback as to help the DJ refine their performance.

Rotary touch pads have been incorporated into portable audio devices 300. The typically have function switches 301 as well as a touch sensitive surface 302. The touch sensitive surface 302 responds to circumferential motion from the user. Because they tend to be small, performing an accurate scratch effect suitable for live performance by a professional DJ is not desirable. For this reason, devices have been created that externalize the critical performance control functionality. For example, see US 2007/0280489 to Roman.

Display technology has been incorporated into DJ platters. US 20070234889 to Rotolo de Moraes suggests the use of multiple sensor under the jog wheel control to provide discrete regions of functionality. In addition Rotolo de Moraes teaches visual feedback on a DJ control wheel through discrete LEDs mainly as a learning tool and to provide some type of scoring mechanism for competition. US 2007/0274181 to Yao teaches a way of providing visual feedback through the use of blinking lights on the platter surface.

However, none of the above mentioned devices solve the problem of portability, durability, and accuracy for creating scratch effects on a DJ control surface.

OBJECTS AND SUMMARY OF THE INVENTION

It is therefore an object of the present invention to provide an improved control and display device for DJs that is portable, durable, and provides accurate and precise control of audio parameters including a scratch effect.

This and other objects are attained in the present disclosure by a DJ control device that provides a substantially circumferentially shaped multi-function touch pad control device where the outer portion of the touch pad responds to circumferential motion and the center of the touch pad responds to linear motion. The circumferential shape and response to circumferential motion on the outer edge of the touch pad provides the user with an interface that is analogous to a rotating platter. Integrating response to linear motion in the central portion of the touchpad surface provides for an unprecedented degree of control and flexibility not normally available to the DJ on a compact control device.

In one embodiment, the user can create a scratch effect with an up and down linear motion in the central portion of the touch pad device. At the same time, the DJ can create either a scratch effect or jog/shuttle effect on the outer portion of touch pad with a back and forth circumferential motion.

In another embodiment, the user can obtain direct real-time visual feedback of their performance from display elements, typically LEDs, or an LCD display mounted below the plane of the touch pad. These display elements can be mounted directly under the touch pad, in the case of a translucent touch pad device, mounted to the side of the touch pad, or a combination of the two. The display elements are capable of displaying both circumferential motion and linear motion.

In another embodiment, mode or assignment switches can be used to change the functionality of the touch pad device. For example, a "Vinyl" mode switch closely analogous to the features and functions a DJ performs on a turntable platter.

The outer portion of the touch pad surface can simulate a jog, shuttle or a coarse scratch effect depending on the type of circumferential motion provided by the user. The central portion however, responds to linear motion back and forth motion as a scratch effect, an effect unavailable on a rotating platter device. A second example, the "Trigger" mode switch gives the ability to use the touch pad device to load and select song tracks. The outer portion of the touch pad device, responding to circumferential motion, can be used to scroll through the song tracks quickly. This is useful if there are a large number of song tracks. The central portion of the touch pad device, responding to linear motion, can be used to slowly scroll through and select song tracks.

In still another embodiment, the touch pad device may be further configured so that portions of the outer circumferential portion can be segmented to provide an area circumferentially shaped on the outer edge and partially parallel to the linearly responsive central portion of the touch pad on the inner edge. That portion of the outer circumferential surface could respond to both linear and circumferential motion. In this embodiment, mode select switches can be used to control functionality such as "Vinyl" mode and "Trigger" mode in substantially the same manner as previous described. It can also allow for additional control modes that require multiple linear controls. For example, equalization typically requires three controls, one from bass, mid range, and treble.

DESCRIPTION OF THE DRAWINGS

Further objects and advantages of the invention will become apparent from the following description and from the accompanying drawings, wherein.

DETAILED DESCRIPTION OF THE PREFERRED EMBODIMENT

Figure 1:
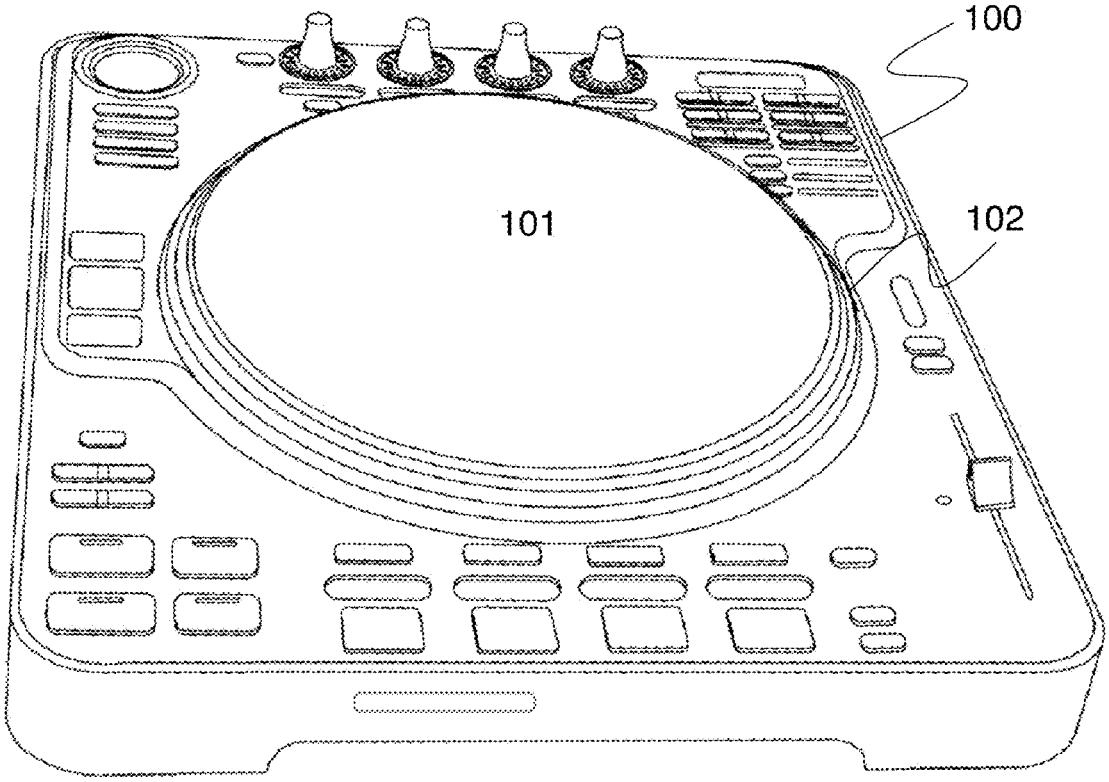
FIG. 1 is a typical DJ control surface in the prior art.
Figure 2:
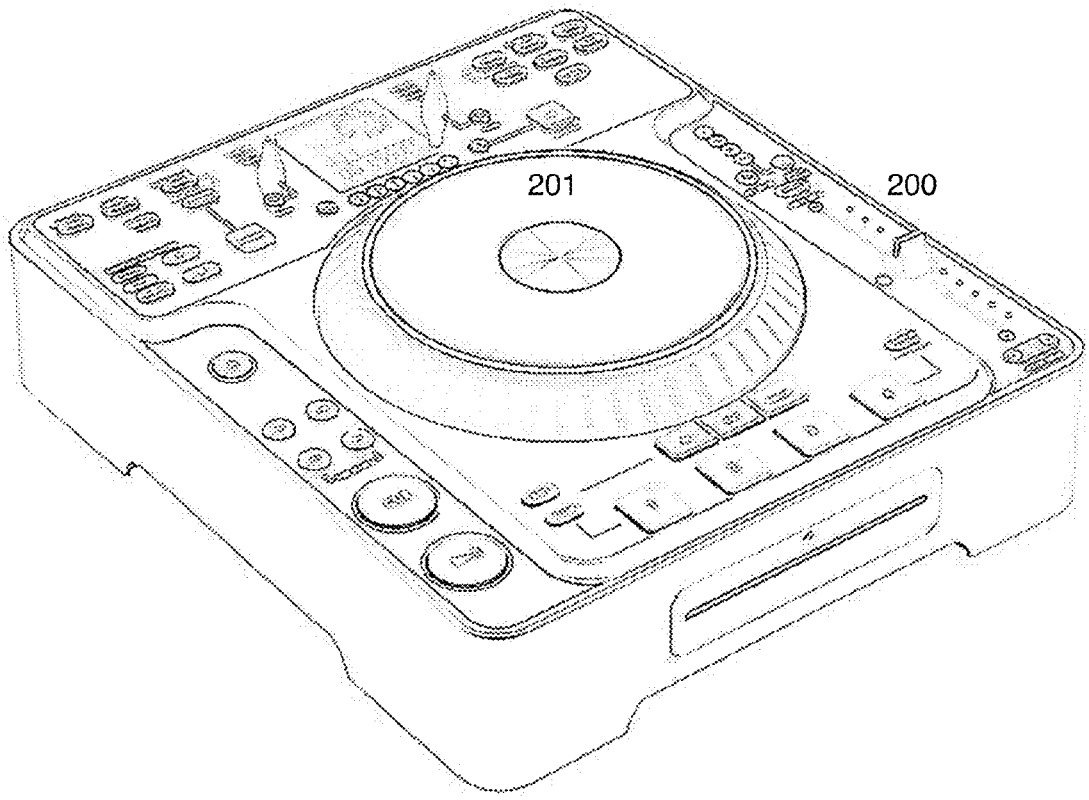
FIG. 2 is a typical DJ CD player with a user rotatable platter in the prior art.
Figure 3:
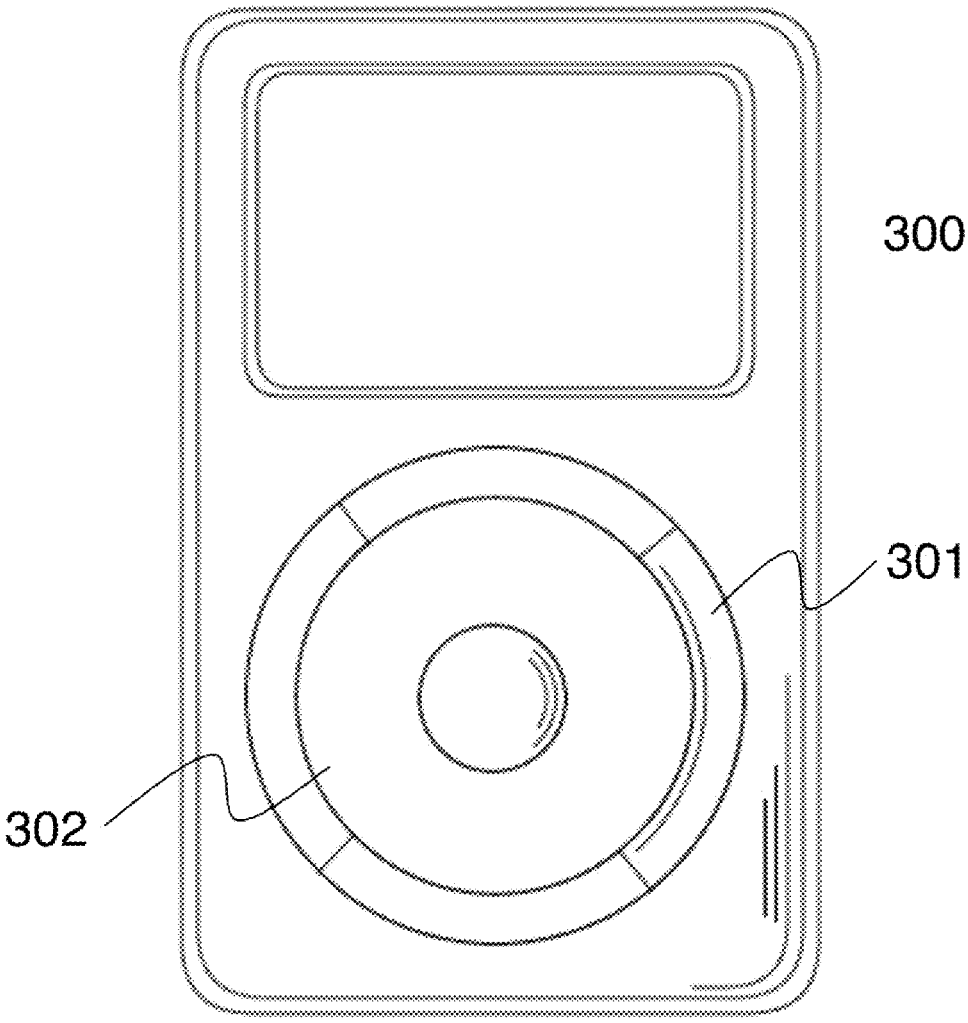
FIG. 3 is a typical touch sensitive media player that responds to annular motion in the prior art.
Figure 4:
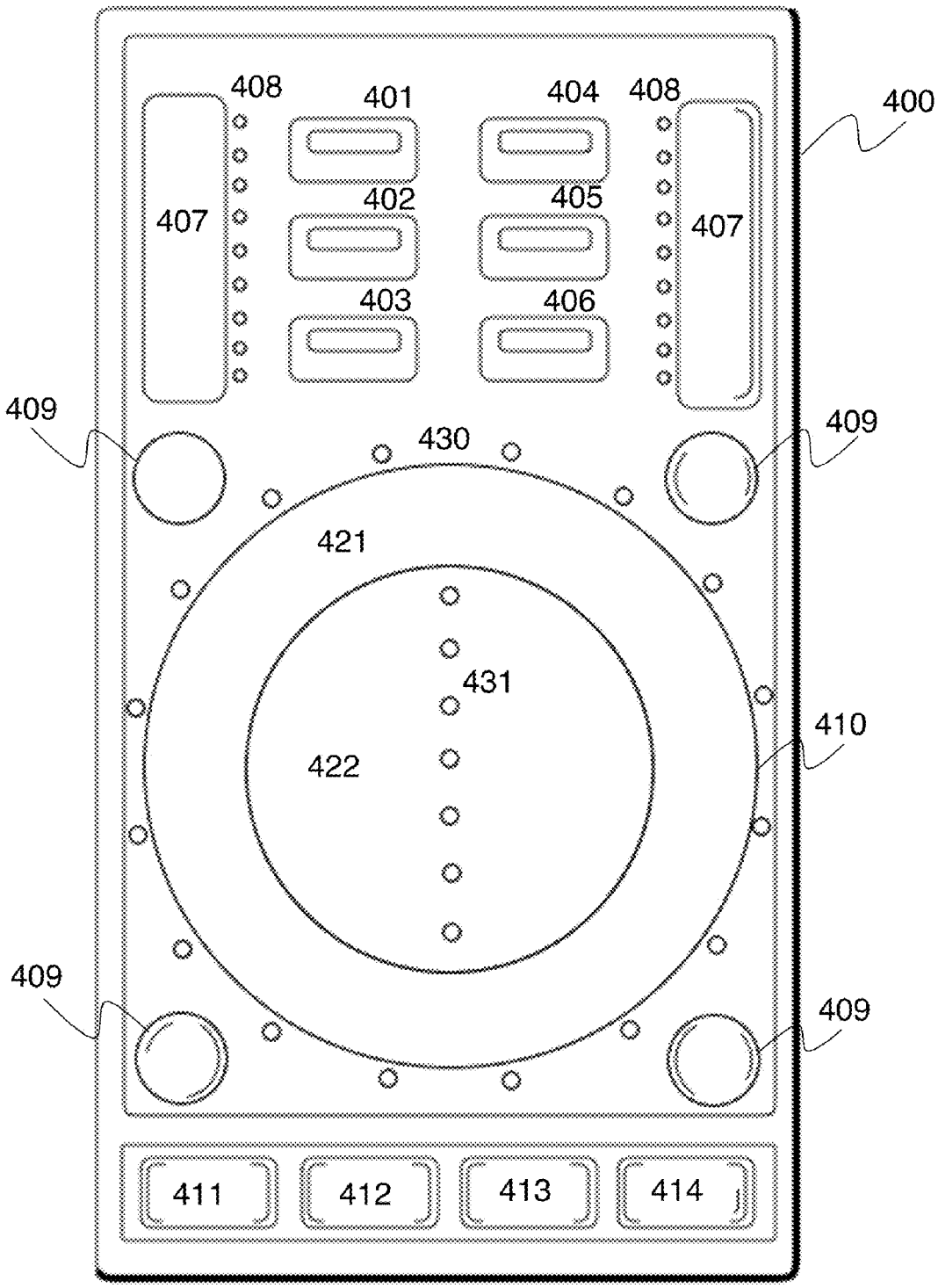
FIG. 4 is an embodiment of the invention illustrating the touch surface and other controls
Figure 10:
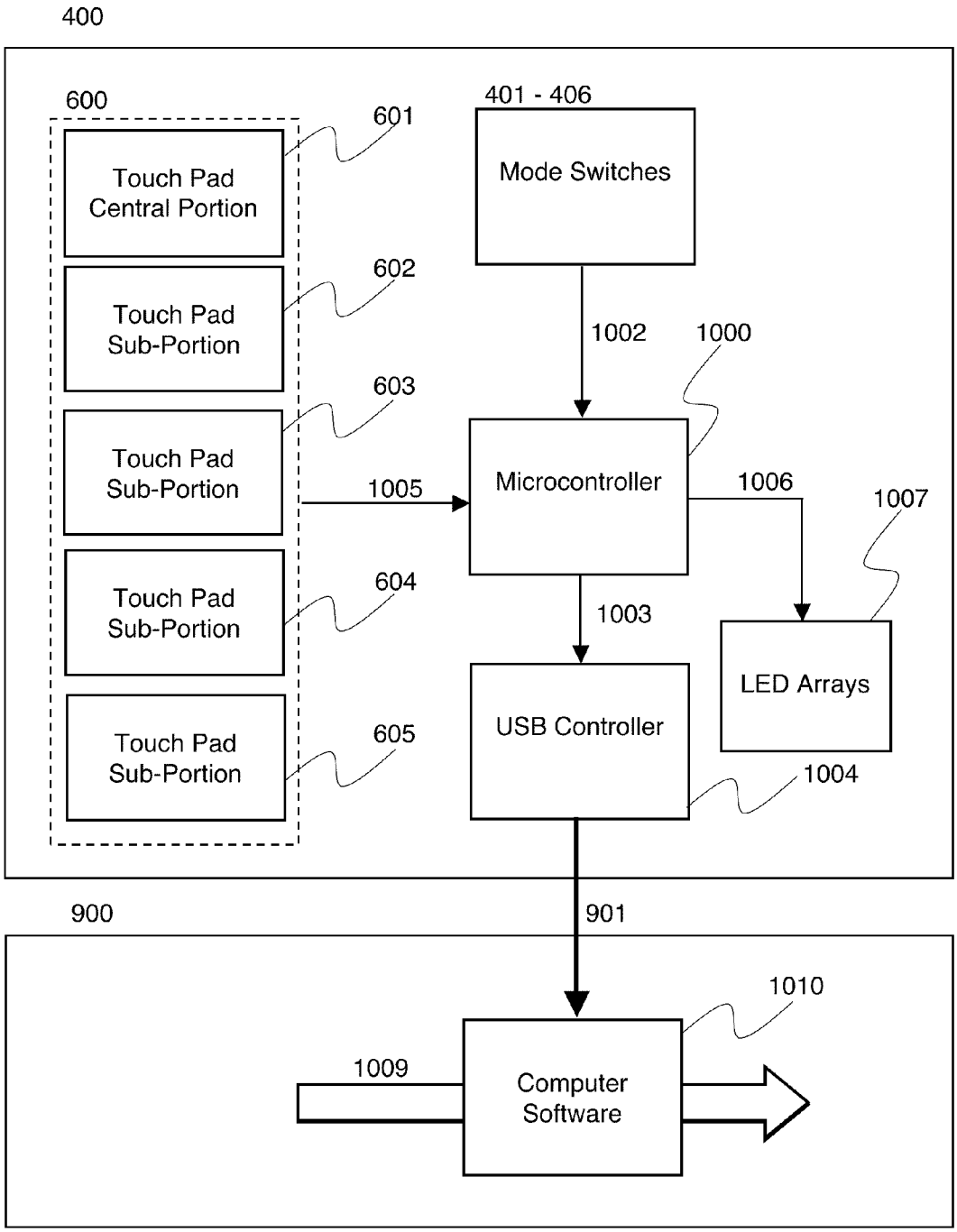
FIG. 10 is a block diagram of an embodiment of the invention where the digital audio processing occurs in an external computer.

Referring now to the drawings in detail, wherein like numerals indicate like elements throughout the several views. FIG. 4 discloses an embodiment of the present invention. A self-contained DJ controller 400 has a substantially circumferential touch sensitive surface 410. The touch sensitive surface in the present embodiment is a capacitive touch sensor. Those skilled in the art will recognize that other touch pad technology may be substituted. The touch sensitive surface 410 is divided into a circumferential portion 421 and a central portion 422. The circumferential portion 421 is disposed to respond to circumferential or rotary motion imparted by the user. In this embodiment the central portion 422 is disposed to respond only to linear motion imparted by the user. This is accomplished by programming an internal processor 1000, typically a microcontroller, as shown in FIG. 10, within the DJ control device 400, to accept only vertical linear motion from the central portion 422. the internal processor 1000 may also be programmed to accept both vertical and horizontal linear motion from the central portion 422 referred to in FIG. 4. Referring back to FIG. 4, alternatively, the touch sensitive surface 410 may be formed from multiple touch pad devices where one touch pad is used where one touch pad is shaped to form the circumferential portion 421 and the other touch pad is shaped to form the central portion 422.

Other controls included in this embodiment of DJ controller 400 are mode select switches 401-406, general purpose linear touch sensitive controls 407 and corresponding display 408, trigger selectors 409, and transport selectors 411-414. The mode select switches 401-406 determine what audio parameters the DJ controller 400 will control. In this embodiment six sets of audio parameters may be controlled these are: FX 401, LOOP 402, VINYL 403, EQ 404, TRIGGER 405, and DECK 406. Other modes of operation and control are possible in addition to those described in the present embodiment. In the present embodiment, the mode select switches are standard tact switches. However, other means to select mode of operation are possible, this including any equivalent standard electronic selection apparatus. This includes but is not limited to standard momentary push switches, membrane switches, reed switches, and capacitive touch pad switches. The general-purpose linear touch sensitive controls 407 in this embodiment are used to control sound level or gain, and pitch. Other functionality may be assigned to the general-purpose linear touch sensitive controls 407. Each general-purpose linear touch sensitive control 407 has a corresponding display element 408 that gives the user feedback as to the current control level. This corresponding display element 408 in this embodiment is a column of LEDs but may also be an equivalent display including but not limited to LCD, oLED or vacuum florescent or plasma. The trigger selectors 409 trigger specific actions based on which mode select switch 401-406 is actuated. The transport selectors 411-414 simulate the functionality of a transport control on an DJ audio playback unit. In this embodiment, the transport controls include PLAY 411, CUE 412, SYNC 413, and TAP 414.

Figure 5:
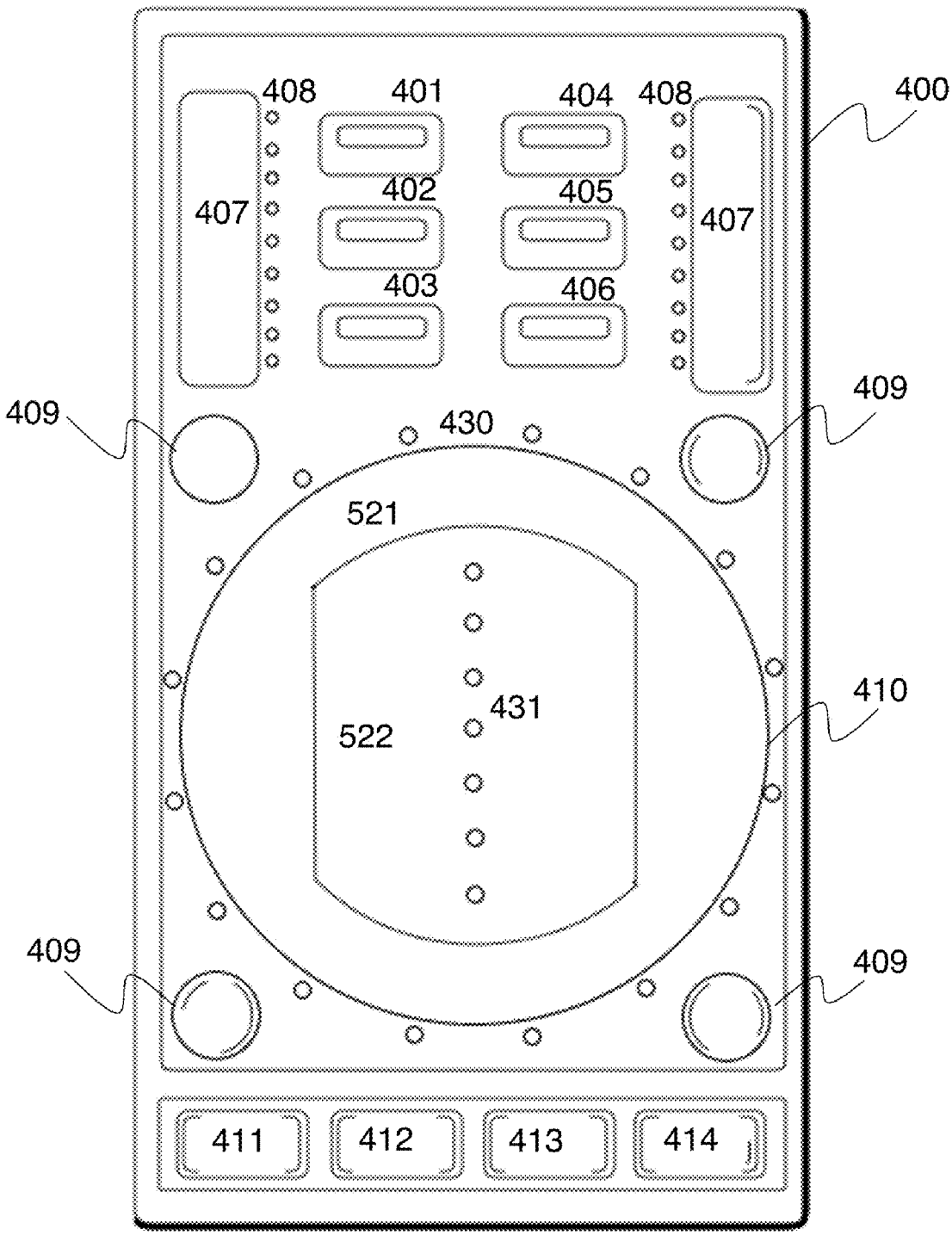
FIG. 5 is an embodiment of the invention showing the touch surface with alternative shape for inner central portion and outer circumferential portion.

FIG. 5 shows an alternative embodiment of the present invention. The substantially circumferentially shaped touch sensitive surface 410 is divided into two portions. A central portion 522 and a circumferential portion 521. LED segments 430 are circumferentially arranged surround the edge of the outer portion of the circumferential portion 521. These LEDs act as position indicators for the circumferential portion 521 and are disposed toward indicating circumferential motion and position. LED segments 431 are vertically placed and linearly arranged the central portion 522. They act as position indicators for the central portion 522 indicating linear motion and position imparted by the user. In this embodiment the LED segments 430 are positioned above the plane of the touch sensitive surface 410. LED segments 431 are positioned parallel with the plane of the touch sensitive surface 410 in order to reduce interference with user's control of the touch sensitive surface 410. In alternative embodiments, a transparent or translucent touch pad may be used. This would allow the LED segments 430 and 431 to be placed underneath the plane of the touch sensitive surface. While LEDs are used in this embodiment as pluralities of visual indicators, other display technologies and their equivalents are also possible. These include but are not limited to oLEDs, LCDs, plasma, and vacuum fluorescent displays.

In the present embodiment, the central portion 522 has four sides. The top and bottom are arced segments that are substantially concentric with the outer edge of the circumferential portion 521. The left and right sides are substantially parallel to each other and substantially parallel the bases of the arced segments. The circumferential portion 521 and central portion 522 are formed from two custom shaped capacitive touch pads with no gap between the two in order to form a continuous surface.

Figure 6:
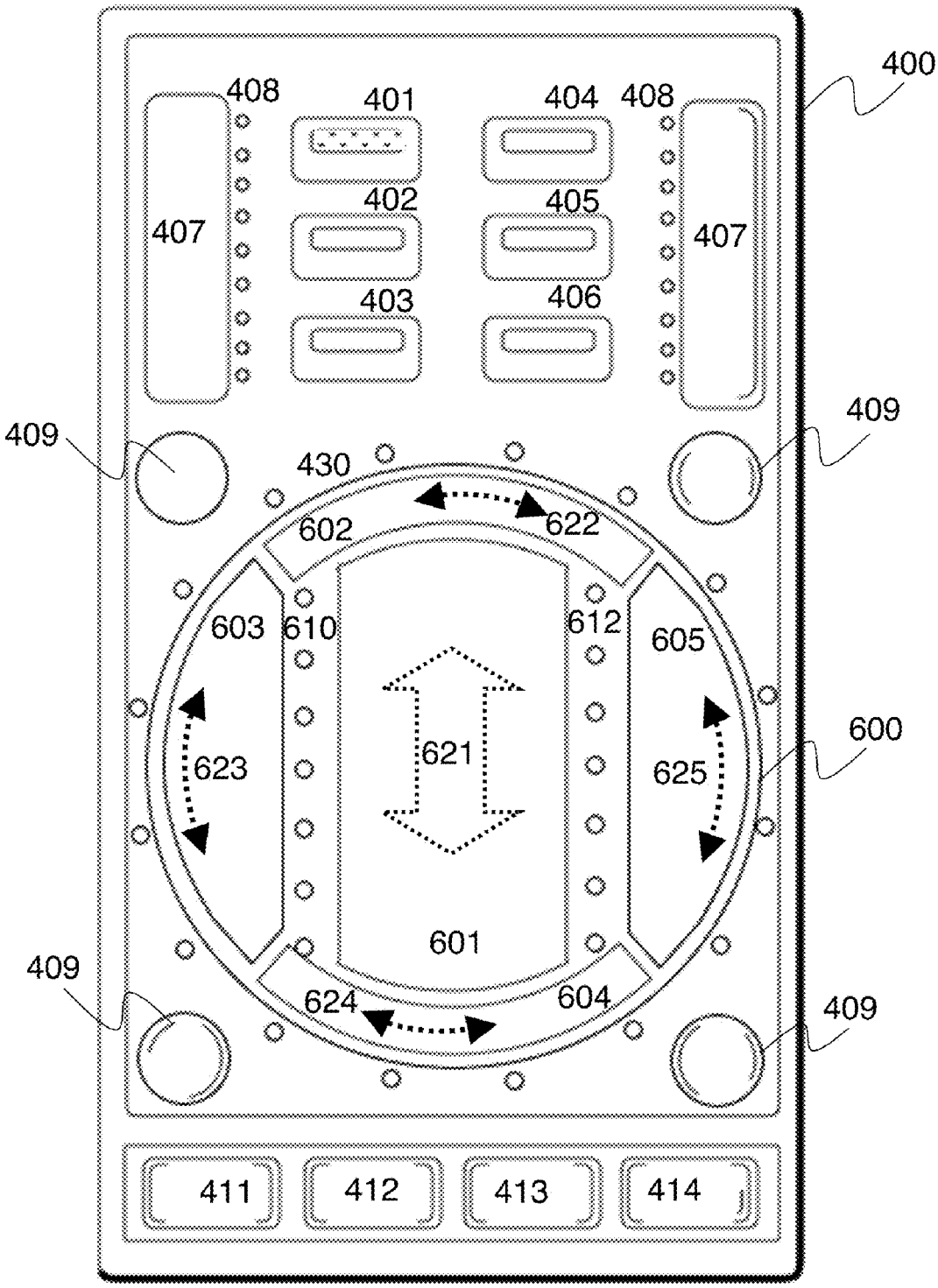
FIG. 6 is an embodiment of the invention demonstrating multiple circumferential sub-portions.

In FIG. 6, substantially circumferentially shaped touch sensitive surface 600 is divided into two portions: a central portion 601 and a circumferential portion 602-605. The circumferential portion is divided into form sub-portions each sub-portion 602-605 is a separate capacitive touch pads. The central portion 601 is formed from a single capacitive touch pad. In this embodiment each sub-portion 602-605 is separated by a small gap. Similarly, the central portion 601 is separated from each of the sub-portions 602-605 by a small gap. In other embodiments, the gaps may be eliminated in order to form a continuous control surface. As in previously described embodiments, visual indicators 430 surround the circumferential portion 602-605 and indicate circumferential motion imparted by the user.

As discussed previously, each of the mode select switches 401-406 determine what audio parameters will be controlled by DJ controller 400. In addition, selection of a mode of operation by a mode select switch 401-406 can change the responsiveness of each portion and sub-portion of the touch sensitive surface 600. For example, selecting the VINYL mode select switch 403 places the DJ controller 400 in turntable simulation mode. In this mode the internal processor 1000 controls positional based audio parameters such as jog, shuttling, or scrubbing through play position as well as the well-known DJ "scratch effect". In VINYL mode, all sub-portions 602-604 act as a single circumferential portion and in this embodiment is disposed to only respond to circumferential motion as illustrated by user imparted motion 622-625. The central portion 601 is disposed to respond to only vertical linear motion. A fast vertical back and forth motion imparted by the user in the central portion 601 is used in VINYL mode to impart a "scratch effect".

Figure 7:
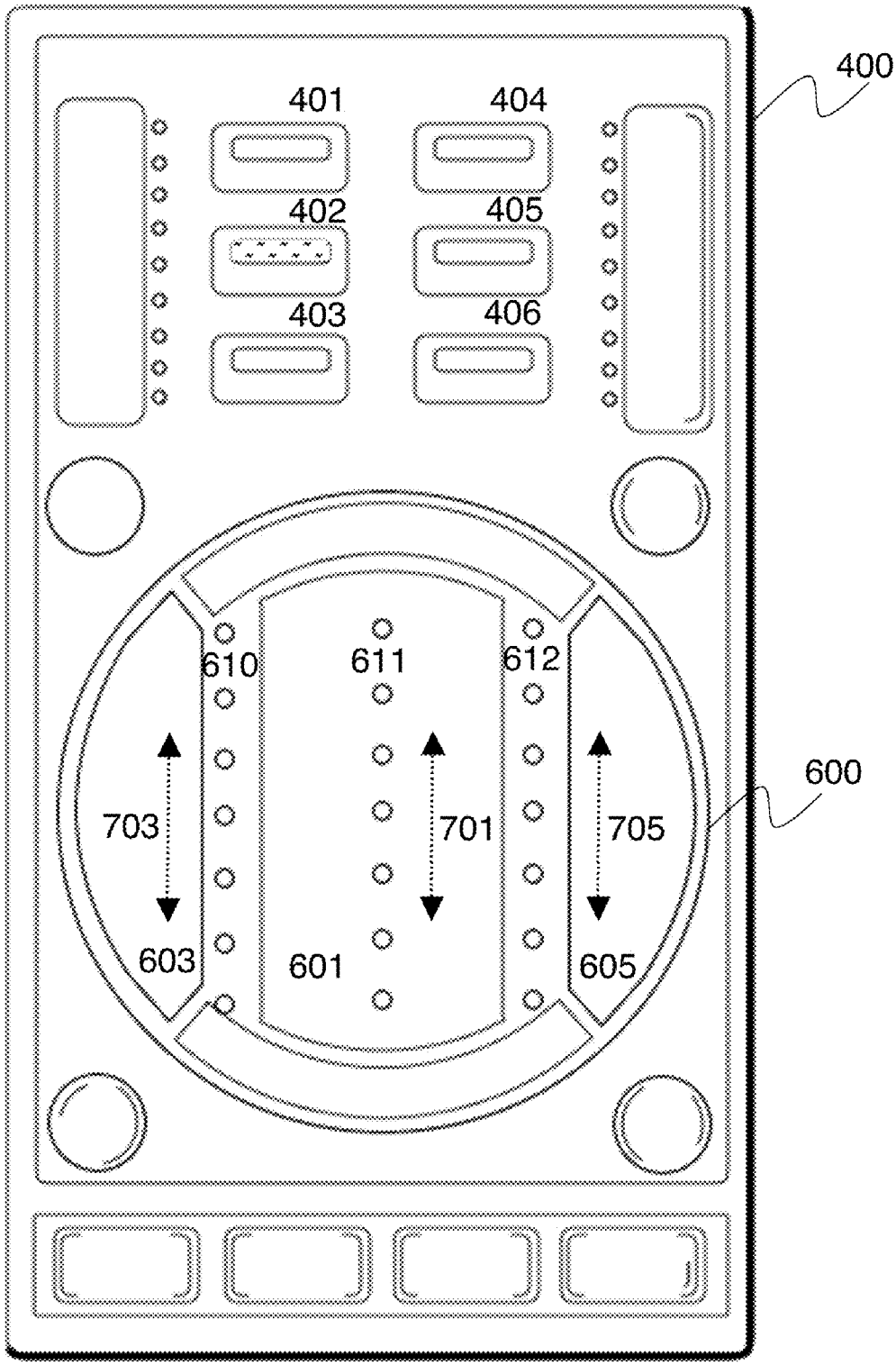
FIG. 7 is an embodiment of the invention demonstrating multiple circumferential sub-portions where two of the regions are capable of linear motion.

Selecting either the FX mode select switch 401 or EQ mode select switch 404 will configure the touch pad as in FIG. 7. The internal processor 1000 accepts user input only from the central portion 601 and circumferential sub-portions 603 and 605. User input from sub-portions 602 and 604 are ignored. In addition, the internal processor 1000 is disposes to accept vertical linear motion instead of circumferential motion sub-portions 603 and 605. In the embodiment of FIG. 6 and FIG. 7, in modes of operation that accept user input from sub-portions 602 and 604, the processor 1000 will only accept circumferential motion, not linear motion, from sub-portions 602 and 604.

Visual indicators 610, 611, and 612 are active in both FX mode and EQ mode in the present embodiment, while visual indicator 430 is inactive. Visual indicator 610 is disposed to indicate vertical linear motion imparted by the user in portion 603. Visual indicator 611 is disposed to indicate vertical linear motion imparted by the user in central portion 601. Visual indicator 612 is used to indicate vertical linear motion imparted by the user in sub-portion 605. In EQ mode, in the present embodiment, sub-portions 603, 605, and the central portion 601 are each used to control a single equalizer band, low, high, and mid frequencies respectively. In FX mode, in the present embodiment, sub-portions 603, 605, and the central portion 601 are each used to control a different effects parameter.

Figure 8:
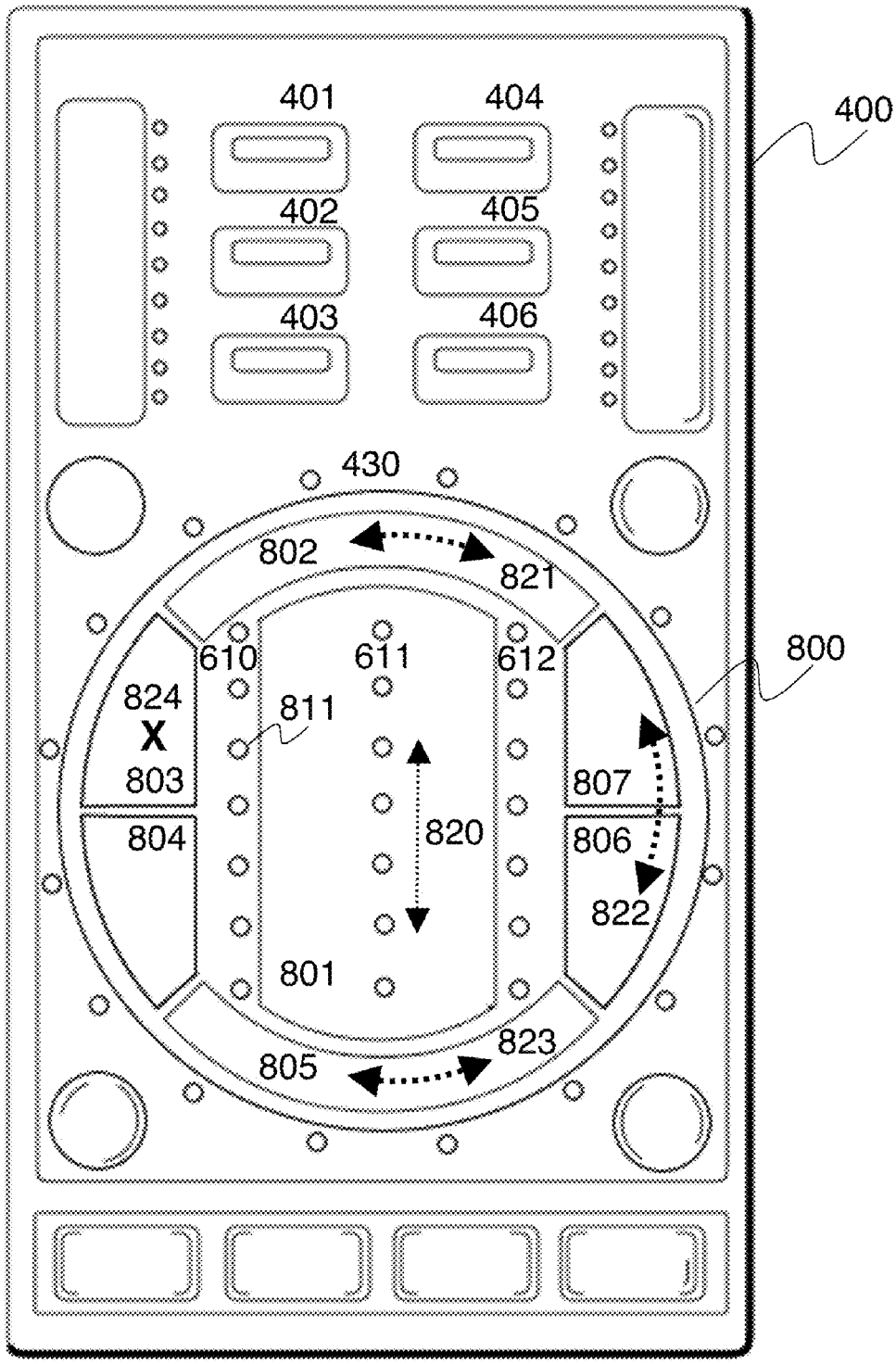
FIG. 8 is an embodiment of the invention demonstrating multiple circumferential sub-portions where several of the regions are capable of accepting input interpreted as switch actuation.

FIG. 8 shows an embodiment of the DJ controller 400 has a touch sensitive surface 800 divided into a central portion 801 and a circumferential portion that includes sub-portions 802-807. In the present embodiment, each of the circumferential sub-portions 802-807 is each separated by a small gap. Similarly the central portion 801 is also separated from the circumferential sub-portions 802-807 by small gaps. In other embodiments the gaps may be eliminated to form a contiguous touch pad surface. With the VINYL mode select switch 403 actuated, the internal processor 1000 accepts circumferential motion from the user on sub-portions 802-807 and treats them as if there were one contiguous touch pad. For example, user input 822 across sub-portions 806 and 807 will be treated as on continuous motion. The internal processor 1000 will interpolate the movement across the gap between sub-portions 806 and 807. In the present embodiment, in VINYL mode, the processor 1000 ignore horizontal or circumferential motion from the central portion 801 and will only accept vertical linear motion. In the present embodiment, depending on the mode of operation, the internal processor 1000 will either accept circumferental motion from the user in sub-portions 802 and 805. For example, in VINYL mode user input 821 and 823 would be accepted. In FX or EQ mode, user input 821 and 823 would be ignored.

In LOOP mode, in the present embodiment, sub-portions 803, 804, 806, 807 and central portion 801 act like trigger switches. The internal processor 1000 will interpret any touch in sub-portions 803, 804, 806, 807 and central portion 801 as a switch triggering action. The user will typically tap on one of sub-portions 803, 804, 806, and 807 or central portion 801 in order to actuate a specific audio looping event, for example tapping 824 on sub-portion 803. All motions, for example 822 or 820 will be ignored and interpreted as a single actuating event. The internal processor 1000 will ignore any user input from sub-portions 802 and 805.

In LOOP mode, in the present invention, the visual indicators 610, 611, and 612 only light a single LED to indicate which portion or sub-portion was tapped. For example, user tapping of sub-portion 803 at location 824 will cause LED 811 to illuminate.

Figure 9:
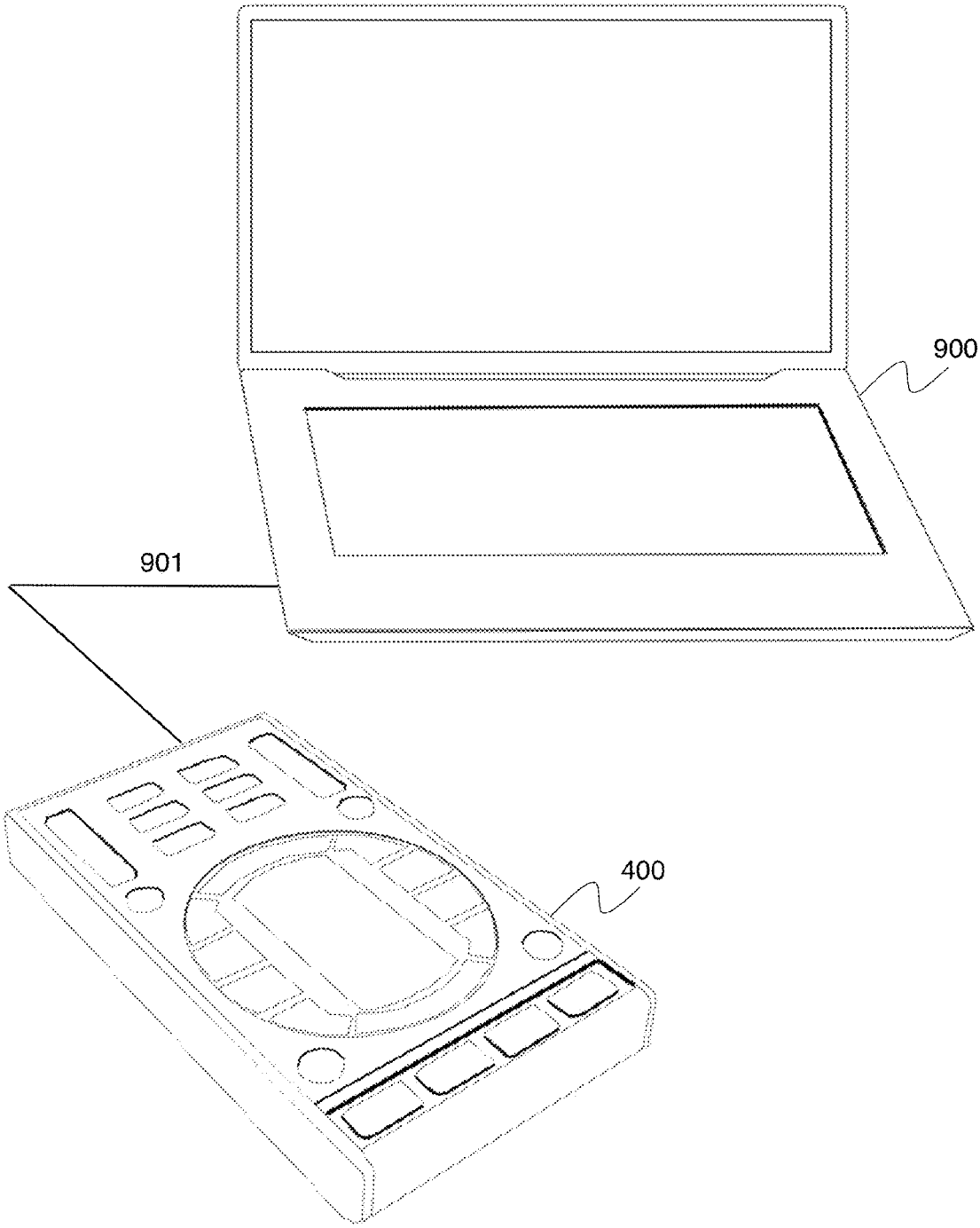
FIG. 9 is an embodiment of the invention connected to an external computer.

Referring to FIG. 9, in a present embodiment, the DJ controller 400 is connected to a personal computer 900. In this embodiment, it is connected via cable 901 by a standard computer protocol such as USB or FireWire. This connection may be also made by other standard computer protocols, for example, wireless 802.11, 802.15 or Bluetooth. In the present embodiment, audio processing takes place inside the personal computer 900. The DJ controller 400 supplies the control signal disposed to communicate with the means for processing the audio signal within the computer 900. This may be the computer's central processor, a sub-processor, a dedicated digital audio processing device, or a software routine within the computer.

FIG. 10 is a block diagram of the DJ control device 400 of FIG. 6 attached to an external personal computer 900 as in FIG. 9. In this embodiment, touch sensitive surface 600 is divided in a central portion 601 and a circumferential portion. The Circumferential portion is divided into sub-portions 602-605. The central portion 601 and each of the sub-portions 602-605 of the circumferential portion are separate capacitive touch pad input devices. These are connected through standard digital signal communication protocol 1005, for example I2S, I2C, or parallel data communication, to the internal processor 1000. In the present embodiment, the internal processor 1000 is a microcontroller. However one skilled in the art will recognize that other combinations are possible, for example, an FPGA, ASIC, PLD alone or in combination with a microcontroller. In addition, it is possible that the touch sensitive device 600 have its own controller or controllers built-in to touch pads 601-605. These would communicate through standard digital signal communication protocol 1005 to internal processor 1000.

The processor receives input from mode switches 401-406 through signal 1002. In the present embodiment, only one mode switch 401-406 may be selected at a time. Those skilled in the art will recognize many ways connect switch signals 1002 to an internal processor 1000. Based on what modes switch 410-406 is selected, the internal processor 1000 will either accept or ignore input and types of input, i.e. tapping, circumferential motion, or linear motion, from the central portion 601 and each of the circumferential sub-portions 602-605. Depending on the mode of operation selected by mode switches 401-406, the internal processor 1000 will format the data received from the touch sensitive surface 600 as a series of commands. In the present embodiment, the data is formatted into MIDI data. MIDI data is used because it is a standard command protocol for music equipment and can be readily recognized and used by external music software 1010 residing on a personal computer 900. Other types of command protocol are possible including proprietary data protocol that can be translated to MIDI or other standard data format via middleware software within a personal computer 900. The series of commands are transmitted 1003 to digital communications protocol device 1004. In the present invention, this is a USB controller. The USB controller will format the data according to USB communication protocol. Other digital communications protocols are possible, for example, IEEE-1394 (FireWire), Ethernet, wireless 802.11, wireless 802.15, or wireless BlueTooth. In the case of FireWire, the digital communications protocol device would actually be two devices: a IEEE-1394 PHY driver and LINK layer controller. Those skilled in the art will recognize that digital communications protocol device 1004 can be combined with the internal processor 1000 into a single device.

The digital communications protocol device 1004 transmits standard computer communications protocol 901 to a personal computer 900. In the present embodiment, the standard communications protocol would be USB transmitted through a USB cable. The personal computer 900 receives the standard computer communications protocol typically through a software driver that resides below the operating system. The software driver communicates to the operating system. The operating system, in turn communicates to computer application software 1010. The computer application software interprets the commands that were originally generated by the processor 1000 internal to the DJ controller 400 and in turn manipulates or modulates a digital audio stream 1009 within the computer 1010.

Within the DJ controller 400, the internal processor 1000 drives LED arrays 1007. In the present embodiment, this is done through processor ports 1006. The processor 1000 may either drive the LEDs directly based on user manipulation of touch sensitive surface 600 or indirectly from commands received back from the computer 900.

Figure 11:
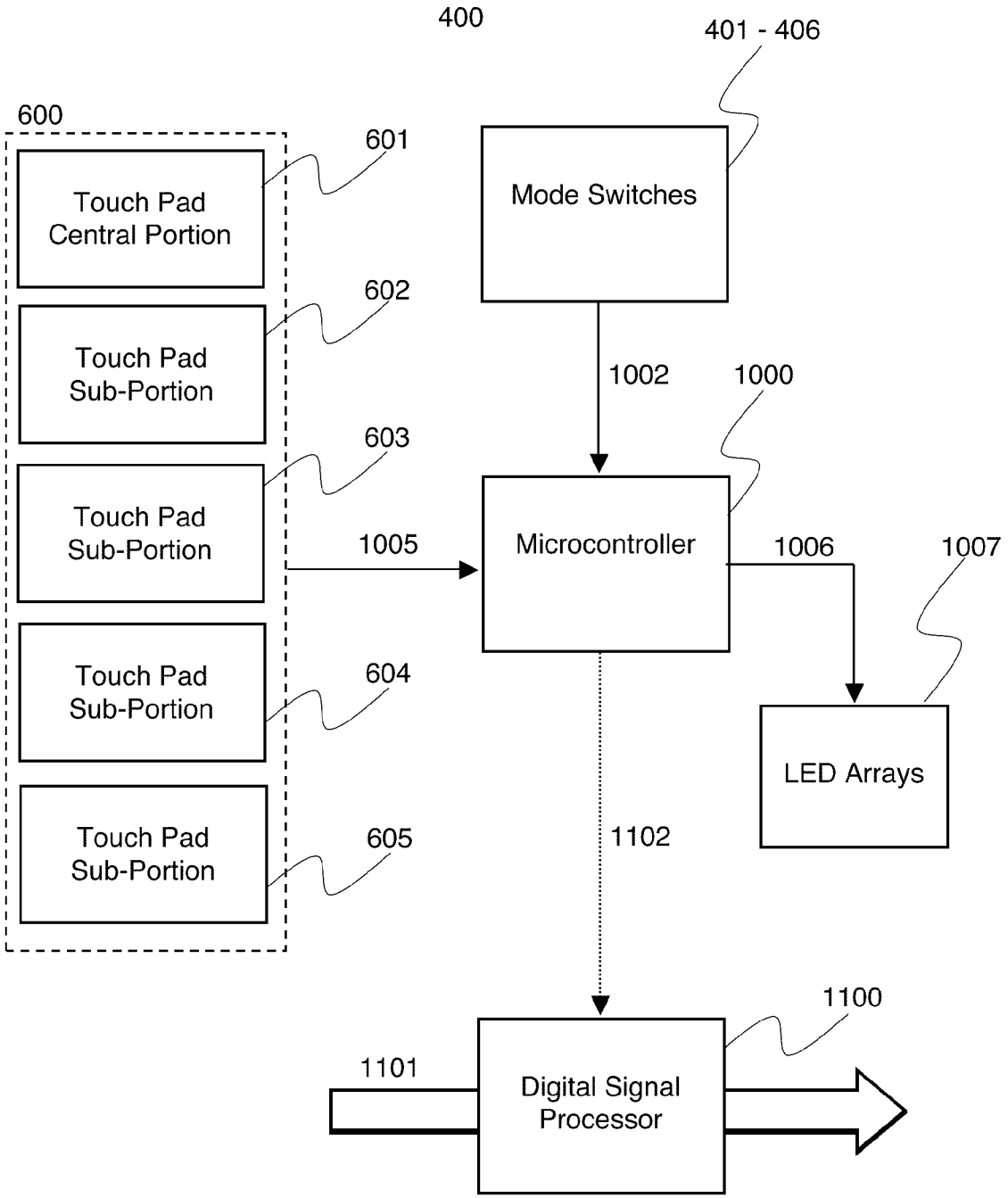
FIG. 11 is a block diagram of an embodiment of the invention where the digital audio processing occurs internally.

FIG. 11 shows an alternative block diagram where instead of audio processing taking place inside a computer 900, it takes place within the DJ controller 400. The processor reads and interprets input from the touch sensitive control surface 600 and mode switches 401-406 as described in the preceding paragraphs. Instead of transmitting data to a computer, the internal processor 1000 transmits command data through standard digital data protocol, for example I2S or I2C, to an internal digital signal processor 1100. The digital signal processor acts on the command data and manipulates a digital audio stream that resides inside the DJ controller 400. This manipulation can be, but is not limited to, a DJ "scratch effect", equalization (tone control), DJ effects such as beat synchronized phasing and flanging, audio looping, and external sound sample triggering.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

What is claimed is:

1. A disc jockey controller, comprising:

a substantially circumferential shaped touch sensitive surface with at least two discrete input devices; wherein the at least two discrete input devices comprise at least one central portion input device and at least one circumferential portion input device; wherein said at least one central portion input device is disposed to respond to linear motion imparted by a user and wherein said at least one circumferential portion input device is disposed to respond to circumferential motion imparted by a user; and a processing device disposed to process data imparted from said touch sensitive surface and create a control signal; wherein said control signal is disposed to communicate with means for processing an audio signal in order to manipulate a digital audio data stream; wherein user manipulation of said at least one central portion modulates the digital audio data stream in order to impart a "scratch effect".

2. The device of claim 1, further comprising wherein data imparted from said at least one circumferential portion input device manipulates the digital audio data stream in order to impart a "scratch effect".

3. The device of claim 1 wherein said at least one circumferential portion input device is disposed to respond only to circumferential motion imparted by a user.

4. The device of claim 1 wherein said at least one central portion input device is disposed to respond to only linear motion imparted by a user.

5. The device of claim 1, further comprising:

a first plurality of visual indicators linearly arranged and disposed to indicate linear motion imparted by the user; and a second plurality of visual indicators circumferentially arranged and substantially concentric with said at least one circumferential portion input device and disposed to indicate circumferential motion imparted by a user.

6. The device of claim 1 wherein said control signal is disposed to communicate with a personal computer.

7. The device of claim 1 comprising more than two circumferential portion input devices.

8. The device of claim 1 further comprising means to select a mode of operation, wherein the means to select a mode of operation configures said processing device to accept or ignore a user input from said at least one central portion input device and said at least one circumferential portion input device.

* * * * *